US009198550B2

(12) United States Patent
Ryu et al.

(10) Patent No.: US 9,198,550 B2
(45) Date of Patent: Dec. 1, 2015

(54) WINDOW CLEANING APPARATUS AND METHOD OF CONTROLLING THE SAME

(75) Inventors: Man-Hyun Ryu, Sungnam-si (KR); Dong-kyu Kim, Gyeongsan-si (KR); Sung-Hyuk Kang, Daegu (KR)

(73) Assignee: INTELLCTUAL DISCOVERY CO., LTD., Seoul (KR)

( * ) Notice: Subject to any disclaimer, the term of this patent is extended or adjusted under 35 U.S.C. 154(b) by 0 days.

(21) Appl. No.: 14/380,577

(22) PCT Filed: Feb. 29, 2012

(86) PCT No.: PCT/KR2012/001521
§ 371 (c)(1),
(2), (4) Date: Aug. 22, 2014

(87) PCT Pub. No.: WO2013/125742
PCT Pub. Date: Aug. 29, 2013

(65) Prior Publication Data

US 2015/0027494 A1 Jan. 29, 2015

(30) Foreign Application Priority Data

Feb. 23, 2012 (KR) ..... 10-2012-0018703

(51) Int. Cl.
*A47L 1/03* (2006.01)
*A47L 1/02* (2006.01)

(52) U.S. Cl.
CPC .... *A47L 1/03* (2013.01); *A47L 1/02* (2013.01); *A47L 2201/04* (2013.01)

(58) Field of Classification Search
None
See application file for complete search history.

(56) References Cited

U.S. PATENT DOCUMENTS

2011/0308547 A1* 12/2011 Chao ..... 134/18
2013/0014782 A1 1/2013 Ryu

FOREIGN PATENT DOCUMENTS

KR 20-0438170 Y1 1/2008
KR 10-2009-0128110 A 12/2009
KR 10-1071667 B1 10/2011

OTHER PUBLICATIONS

International Search Report of PCT/KR2012/001521 dated Feb. 19, 2013.

* cited by examiner

*Primary Examiner* — Michael Kornakov
*Assistant Examiner* — Ryan Coleman
(74) *Attorney, Agent, or Firm* — Sughrue Mion, PLLC

(57) ABSTRACT

A window cleaning robot according to the present embodiment comprises a first cleaning unit and a second cleaning unit, which are respectively attached to and move on both surfaces of a window by magnetic force. The window cleaning robot further comprises: a first magnetic module included in the first cleaning unit; a second magnetic module included in the second cleaning unit; a magnetic force sensing part for sensing magnetic force between the first magnetic module and the second magnetic module; and a magnetic force controller for controlling the magnetic force between the first magnetic module and the second magnetic module, wherein the first magnetic module comprises a first magnet which is rotationally mounted, and a second magnet and a third magnet disposed on both sides of the first magnet, and the magnetic force controller rotates the first magnet so as to control the magnetic force between the first magnetic module and the second magnetic module.

4 Claims, 9 Drawing Sheets

WINDOW CLEANING APPARATUS AND METHOD OF CONTROLLING THE SAME

CROSS REFERENCE TO RELATED APPLICATIONS

This is a National Stage of International Application No. PCT/KR2012/001521 filed Feb. 29, 2012, claiming priority based on Korean Patent Application No. 10-2012-0018703 filed Feb. 23, 2012, the contents of all of which are incorporated herein by reference in their entirety.

TECHNICAL FIELD

The present invention relates to a window cleaning apparatus

BACKGROUND ART

In general, a window installed at a wall of a building is easily polluted by external dusts and air pollution to spoil the beauty and to be worse-lighted. Therefore, it is preferable to frequently clean the window installed at a wall of a building.

However, cleaning an outer side of the window is harder in comparison with cleaning an inner side of the window. Especially, as the buildings become Manhattanized, cleaning the outer side of the window becomes more dangerous.

DETAILED DESCRIPTION OF THE INVENTION

Objects of the Invention

The object of the present invention is to provide a window cleaning apparatus capable of improve efficiency and stability of operation and a method of controlling the window cleaning apparatus.

Technical Solution

A window cleaning robot comprising a first cleaning unit and a second cleaning unit, which are respectively attached to and move on both surfaces of a window by magnetic force. The window cleaning robot comprises a first magnetic module included in the first cleaning unit; a second magnetic module included in the second cleaning unit; and a magnetic force or tension sensing part for sensing magnetic force between the first magnetic module and the second magnetic module; and a magnetic force controller for controlling the magnetic force between the first magnetic module and the second magnetic module. The first magnetic module comprises a first magnet which is rotationally mounted, and a second magnet and a third magnet disposed on both sides of the first magnet, and the magnetic force controller rotates the first magnet so as to control the magnetic force between the first magnetic module and the second magnetic module.

Advantageous Effects

According to the embodiments of the present invention, in cleaning a window by using inside and outside cleaning units respectively attached to and move on an inner face and outer face of the window, the magnetic force between the inside and outside cleaning units can be sensed to adjust the magnetic force of the magnets included in the cleaning units.

Therefore, the inside and outside cleaning units can attached to and move on the window by a proper magnetic force according to a thickness of the window and operation process of the apparatus to improve performance and stability of the window cleaning apparatus.

EMBODIMENTS OF THE INVENTION

Hereinafter, the present invention is explained referring to figures as follows. The embodiment below may be embodied in many different forms, and this invention is not construed as limited to the embodiments set forth herein. The embodiments are provided for completely explaining the invention to a person ordinary skilled in the art. Therefore, a shape and a size of elements in figures may be exaggerated for clear explaining.

Figure 1:
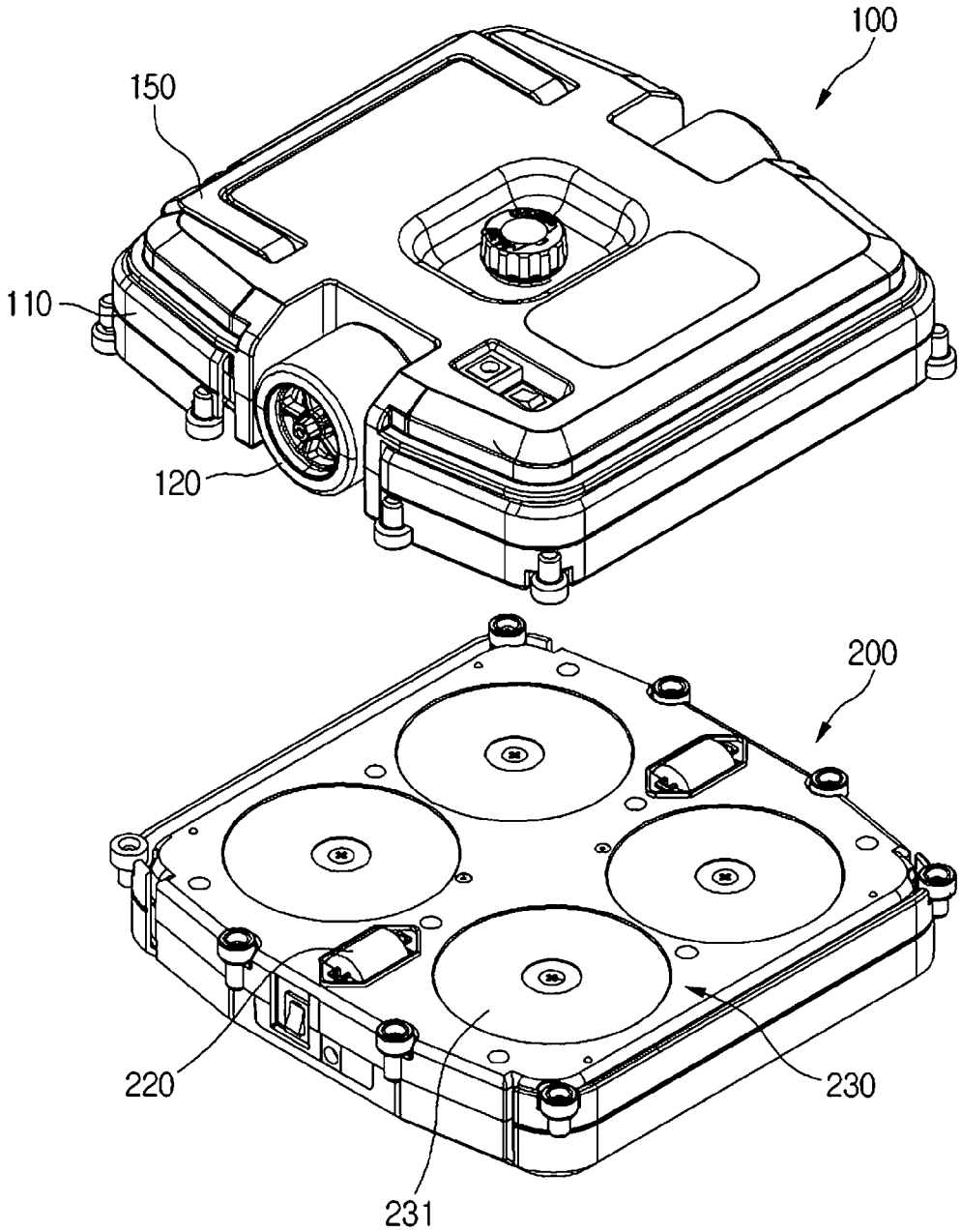
FIG. 1 is a perspective view briefly showing a structure of a window cleaning apparatus according to an embodiment of the present invention.

FIG. 1 is a perspective view briefly showing a structure of a window cleaning apparatus according to an embodiment of the present invention, and the window cleaning apparatus in FIG. 1 includes two cleaning units 100 and 200 respectively disposed at both surfaces of a window.

Referring to FIG. 1, a first cleaning unit 100 may be disposed at an inner surface of the window, and a second cleaning unit 200 may be disposed at an outer surface of the window, and the second cleaning unit 200 moves along the first cleaning module so that window cleaning is performed by the second cleaning unit 200.

The first cleaning unit 100 and the second cleaning unit 200 are attached to each other with the window interposed therebetween by using magnetic modules respectively installed at inside there.

Further, when the first cleaning module 100 moves on the inner surface of the window by an external or built-in power, the second cleaning module 200 can move along the first cleaning module 100 by magnetic force between magnetic modules respectively installed at the first and second cleaning modules 100 and 200.

The first cleaning unit 100 may include an attachment/detachment member 150, for example a handle 150, for attaching the first cleaning unit 100 to a window or for detaching the first cleaning unit 100 from the window, and the second cleaning unit 200 also may include an attachment/detachment member (not shown) installed at an upper part of the second cleaning unit 200.

Therefore, when a user uses the window cleaning apparatus, the user can attach the window cleaning apparatus to a window by using the two attachment/detachment members, that are handles, respectively installed at the first and second cleaning units 100 and 200, and the user can detach the first and second cleaning units 100 and 200 from the window by using the two handles.

On the other hand, the window cleaning apparatus according to the embodiment of the present invention may further include a remote controller (not shown) that allows the user to control operation of the first and second cleaning units 100 and 200.

As described above, the second cleaning unit 200 moves subordinately by magnetic force as the first cleaning unit 100 moves, and a user can control operation of the window cleaning apparatus including the first and second cleaning units 100 and 200 by controlling moving of the first cleaning unit 100 through the remote controller (not shown).

In the present embodiment, the window cleaning apparatus employs a wireless type remote controller (not shown) for a convenience of a user, but the window cleaning apparatus employ a wired type controller or a user can manually operate the window cleaning apparatus.

On the other hand, the window cleaning apparatus according to an embodiment of the present invention, or in more detail, the first cleaning unit 100 disposed on the inner surface of a window may move along a previously set moving path or the window cleaning apparatus may include a sensor (not shown) for sensing dusts, etc. and determine a moving path for improving cleaning efficiency to move along the moving path.

Hereinafter, more detailed structure of the first and second cleaning units 100 and 200 in FIG. 1 will be explained referring to FIG. 2 and FIG. 3.

Figure 2:
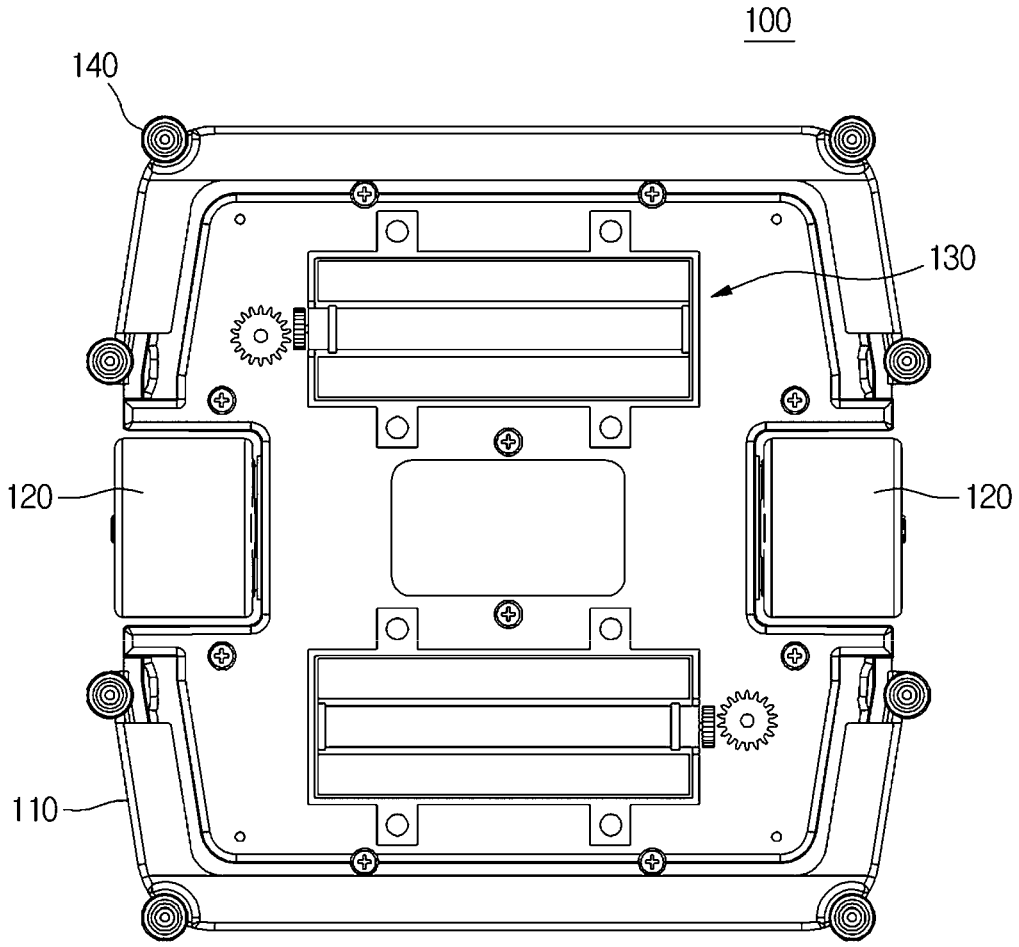
FIG. 2 is a plan view showing a first cleaning unit disposed on an inner surface of a window according to an embodiment of the present invention.

FIG. 2 is a plan view showing a structure of a first cleaning unit 100, and showing an upper face making contact with a window in two faces of the first cleaning unit 100.

Referring to FIG. 2, the first cleaning unit 100 may include a first frame 110, a plurality of first wheel members 120 and a plurality of first magnetic modules 130.

The first frame 110 forms a body of the first cleaning unit 100, and the plurality of first wheel members 120 and the plurality of first magnetic modules 130 may be combined with and fixed to the first frame 110.

On the other hand, a buffer member 140 may be installed at a border of the first frame 110 to minimize impact when the window cleaning apparatus collides with a protrusion such as a window frame while moving. Further, when a sensor (not shown), etc. connected with the buffer member 140 senses impact, the first cleaning unit 100 may change a moving path.

On the other hand, the first cleaning unit 100 may include a plurality of first magnetic modules 130, and the magnetic modules 130 not only generate magnetic force in order that the first cleaning unit 100 and the second cleaning unit 200 are attached to both sides of a window, but also the magnetic force between the first magnetic module 130 and the second magnetic module 233 may be adjusted by rotating a first magnetic force controller of the first magnetic module 130 (refer to FIG. 9 through FIG. 12 and explanation of those). Further detailed explanation regarding to this will be explained referring to FIG. 9 through FIG. 12.

And, the first magnetic module 130 may include a permanent magnet such as a neodymium magnet and generate magnetic force together with the second magnetic module 233 installed in the second cleaning unit 200.

In more detail, the first magnetic module 130 installed in the first cleaning unit 100 and the second magnetic module 233 installed in the second cleaning unit may have respectively magnets with opposite poles. As a result, the first and second cleaning units 100 and 200 respectively disposed at both sides of a window pull each other to be respectively attached to and to be able to move on the both sides of the window.

Further, as another embodiment, the magnetic modules 130 and 233 may be embodied by electromagnet except permanent magnet, and as still another embodiment, the magnetic modules 130 and 233 may be embodied by both of electromagnet and permanent magnet.

The window cleaning apparatus according to embodiments of the present invention is not limited by the magnetic modules 130 and 233 as described above, but various modifications may be possible as long as the first and second cleaning units 100 and 200 are attached to each other and move with a window interposed therebetween.

For example, one of the first and second cleaning units 100 and 200 may include a magnet and the other may include metal that can be pulled by the magnet.

As described in FIG. 2, the first magnetic module 130 may be formed by a plurality of magnets arranged in a horizontal direction, and two of the first magnetic module 130 may be installed in the first cleaning units 100.

For reference, FIG. 2 is a figure for showing the first magnetic module 130 according to an embodiment of the present invention, the first magnetic module 130 may be covered by a cover, etc. when the first cleaning unit 100 is used in a real case.

One of the magnet constructing the first magnetic module 130 is rotated by a motor, and the magnetic force between the first magnetic module 130 and the second magnetic module 233 is adjusted by the rotating magnet. Regarding to this, more detailed explanation will be presented referring to relating figure.

On the other hand, two or more than two of the first wheel member 120 are installed, for example, at for example left and right sides of the first cleaning unit 100, such that a portion of the first wheel member 120 is exposed over an upper portion of the first frame 110, or four of the first wheel member 120 may be disposed at corners, respectively.

For example, the first wheel member 120 may be rotated by a driving part (not shown) such as a motor installed inside of the first frame 110. The first cleaning unit 100 may move in a pretermitted direction as a first wheel member 120 rotates while attached to a window.

On the other hand, the first cleaning unit 100 can move not only in a straight direction but also in a curved direction. In other word, the first cleaning unit 100 can change the moving direction. For example, the first cleaning unit 100 can change the moving direction by changing a direction of a rotation axis of the first wheel member 120 or rotating the two first wheel members 120 of right and left sides in a different rotation speed.

A surface of the first wheel member 120 may be formed by fabric, rubber, silicone, etc. for generating frictional force against a window so that the first cleaning unit 100 can easily move on the inner surface of a window without no-load rotation of the first wheel member 120. Further, the surface of the first wheel member 120 may be formed by a material not forming scratch on a window when the first wheel member 120 rotates.

The first cleaning unit 100 is attached to a window by the magnetic force of the first magnetic module 130, so that normal force in a vertical direction of the window may be applied to the first wheel member 120. Therefore, when the first wheel member 120 is rotated by the driving part (not shown) including a motor, etc., the first cleaning unit 100 can move on the inner surface of a window by a frictional force.

On the other hand, when the first cleaning unit 100 moves by the first wheel member 120, the second cleaning unit 200 attached to the opposite surface of the window, that is the outer surface of the window, can move as if one body with the first cleaning unit 100 along the first cleaning unit 100 through the magnetic force.

Figure 3:
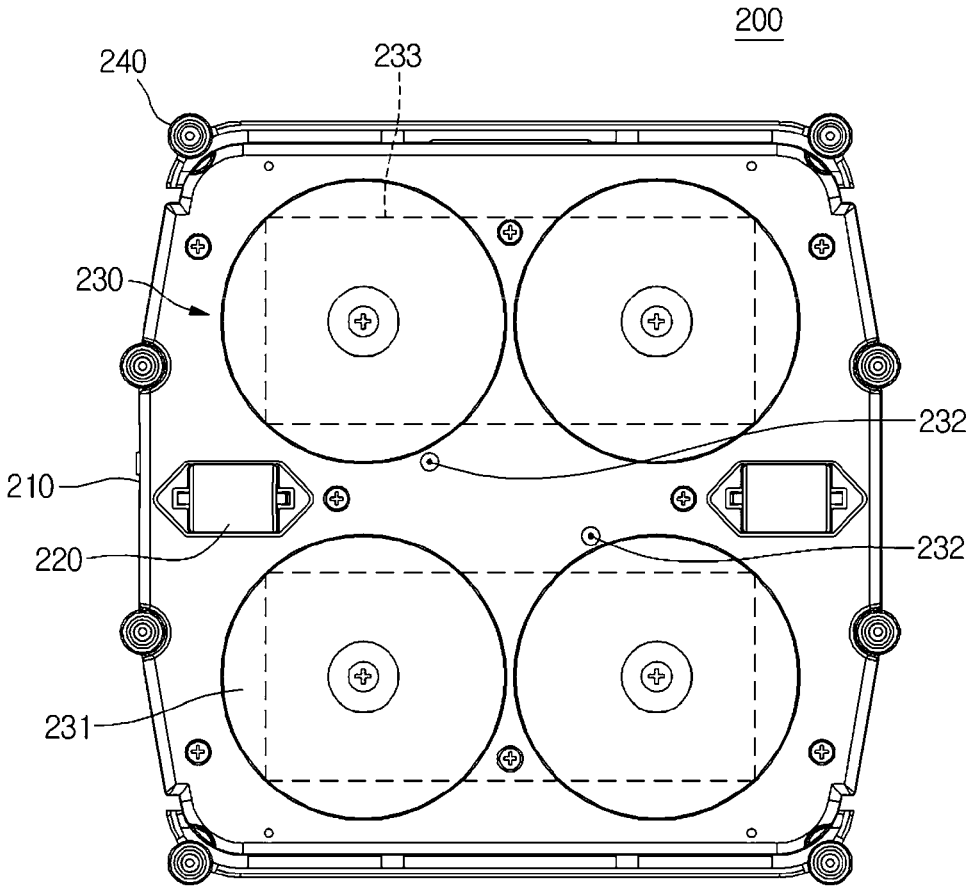
FIG. 3 is a plan view showing a second cleaning unit disposed on an outer surface of a window according to an embodiment of the present invention.

FIG. 3 is a plan view showing a second cleaning unit disposed on an outer surface of a window according to an embodiment of the present invention, FIG. 3 shows a structure of a lower face of the second cleaning unit 200, which makes contact with a window.

Referring to FIG. 3, the second cleaning unit 200 may include a second frame 210, a plurality of second wheel members 220 and a plurality of cleaning modules 230.

The second frame 210 forms a body of the second cleaning unit 200, and may have a shape corresponding to the shape of the first frame 110 of the first cleaning unit 100. For example, the second frame 210 may have a plate structure having a rectangular cross-section.

The plurality of first wheel members 120 is formed at the lower face of the second frame 210, and capable of making the second cleaning unit 200 move along the first cleaning unit 100 by magnetic force.

According to an embodiment of the present invention, the second wheel member 220 is not connected to a driving part such as a motor, unlike the first wheel member 120 installed at the first cleaning unit 100, but the second wheel member 220 is installed at the second frame through an axis in order that the second wheel member 220 can naturally rotate when the second cleaning unit 200 moves.

Therefore, when the second cleaning unit 200 moves with the first cleaning unit 100 through the magnetic force, the second wheel member 220 may rotate to operate as a bearing.

In FIG. 3, the second wheel member 220 is formed to have, for example, a circular cylindrical shape. However, the shape of the second wheel member 220 is not limited to that. For example, the second wheel member 220 may have a globular shape such as a ball bearing.

The cleaning module 230 is formed to be exposed under a lower portion of the second frame 210 to clean a side of a window, for example an outer surface of a window on which the second cleaning unit 200 is disposed.

As shown in FIG. 3, the cleaning module 230 may include a plurality of modules, for example, such as a cleaning pad 231 and a detergent sprayer 232.

On the other hand, each of four disc shapes included in the cleaning module 230 may be formed to be rotatable by a driving part (not shown). Further, the cleaning module 230 may be formed to be protruded from a lower face of the second frame 210 by a specific distance, so that the cleaning module 230 can rotate to perform cleaning of the outer face of the window by frictional force when the second cleaning unit 200 is attached to the outer face of the window.

In order that the cleaning module 230 easily remove dusts by frictional force when rotating, a pad 231 including fabric, rubber, etc. may be attached to exposed face of the cleaning module 230. In this case, in order to improve cleaning performance of the window cleaning apparatus, the pad 231 may be formed by a material of minute fabric or porosity.

Additionally, the cleaning module 230 may include the detergent sprayer 232 for spraying detergent. For example, the detergent sprayer 232 may be connected to a detergent container (not shown) and a pump (not shown) in the second cleaning unit 200 through a flowing path to receive detergent. Therefore, the cleaning module 230 can perform cleaning with spraying detergent to the window by the detergent sprayer 232 when cleaning the window.

On the other hand, the second magnetic module 233 is disposed inside of the cleaning module 230, that is, in the second cleaning unit 200. The second magnetic module 233 may have a shape corresponding to the first magnetic module 130 in the first cleaning unit 100, but the shape of the second magnetic module 233 is not limited to that. The first and second magnetic modules 130 and 233 generate magnetic force in order that the first and second cleaning units 100 and 200 attached to each other with the window disposed therebetween.

The second magnetic module 233 may include magnet such as permanent magnet or electromagnet, or metal. Therefore, the first and second cleaning units 100 and 200 attached at opposite two sides of a window, respectively pull each other so that the first and second cleaning units 100 and 200 are movably attached to the opposite two sides of the window, respectively.

Further, a continuous force is applied to the cleaning module 230 in a direction toward the window by the magnetic force between the first and second magnetic modules 130 and 233 so that frictional force increases to enhance cleaning performance when the cleaning module 230 rotates.

Referring to FIG. 3, the second cleaning unit 200 may further include a plurality of sub cleaning modules 240 formed at corner part of the second cleaning unit 200. The cleaning module 230 is formed at inside of the second frame 210 so that it is very hard to clean the border region of the window. Therefore, the sub cleaning modules 240 of the second cleaning unit can clean the border region such as a window frame of the window.

The sub cleaning module 240 may include a roller member (not shown) that is rotatably installed, and a brush formed at outer circumference surface of the roller member. Therefore, the sub cleaning module 240 can rotate to remove dust of the window frame when the second cleaning unit 200 moves along the window frame.

Additionally, the sub cleaning modules 240 may perform the same function as the buffer member 140 in the first cleaning unit 100. That is, the sub cleaning modules can minimize impact when collided with a protrusion such as a window frame and sense impact.

In the above, the window cleaning apparatus has a structure for cleaning only one surface of a window (that is outer surface of a window) as described referring to FIG. 1 through FIG. 3, but the above is only an embodiment and the present invention is not limited to that.

For example, the first cleaning unit 100 can also include a cleaning module 230 in the second cleaning unit 200, so that the window cleaning apparatus can clean both surface of a window simultaneously.

According to the embodiment of the present invention, the magnetic force between the first and second cleaning units 100 and 200 movably attached to opposite sides of a window, can be sensed and the magnetic force that is sensed can be adjusted to by a previously set value.

Figure 4:
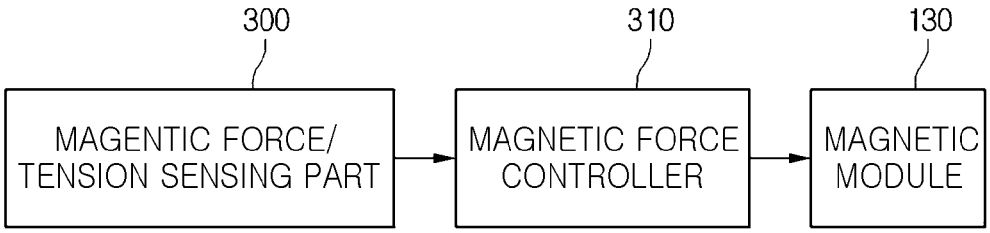
FIG. 4 is a block diagram showing a magnetic force controller installed in the window cleaning apparatus according to an embodiment of the present invention.

Referring to FIG. 4, a magnetic force sensing part 300 senses magnetic force or physical tension between the first and second cleaning units 100 and 200 attached to the window with the window interposed therebetween, and can include a magnetic sensor (not shown) installed at least one of the first and second cleaning units 100 and 200, which can sense the magnetic force and the physical tension.

The magnetic force between the first and second cleaning units 100 and 200 is a force attaching the first and second cleaning units 100 and 200 with a window interposed therebetween, and may be a magnetic force between the first and second magnetic modules 130 and 233 respectively included in the first and second cleaning units 100 and 200.

On the other hand, the magnetic force controller 310 can control the magnetic force of the magnetic module 130 in order that the magnetic force that is sensed satisfies previously set value.

For example, as the magnetic force between the first and second magnetic modules 130 and 233 increases, the window cleaning apparatus can be attached more stably, but the window cleaning apparatus becomes harder in moving since the frictional force between the window and the first and second cleaning units 100 and 200 increases.

On the contrary, as the magnetic force between the first and second magnetic modules 130 and 233 decreases, the window cleaning apparatus becomes easy in moving, but the window cleaning apparatus may fall from a window.

Therefore, the previously set value of the magnetic force may be set considering the stability and mobility of the window cleaning apparatus as described above. In detail, the previously set value may be set in a range of a maximum value that allows the window cleaning apparatus to easily move and a minimum value that allows the window cleaning apparatus to stably attached to a window.

Therefore, the magnetic force controller 310 may adjust the magnetic force between the first and second magnetic modules 130 and 233 to be in the previously set value, when the magnetic force and the physical tension between the first and second cleaning units 100 and 200, which is sensed by the magnetic force sensing part 300, is out of the previously set value range.

Figure 5:
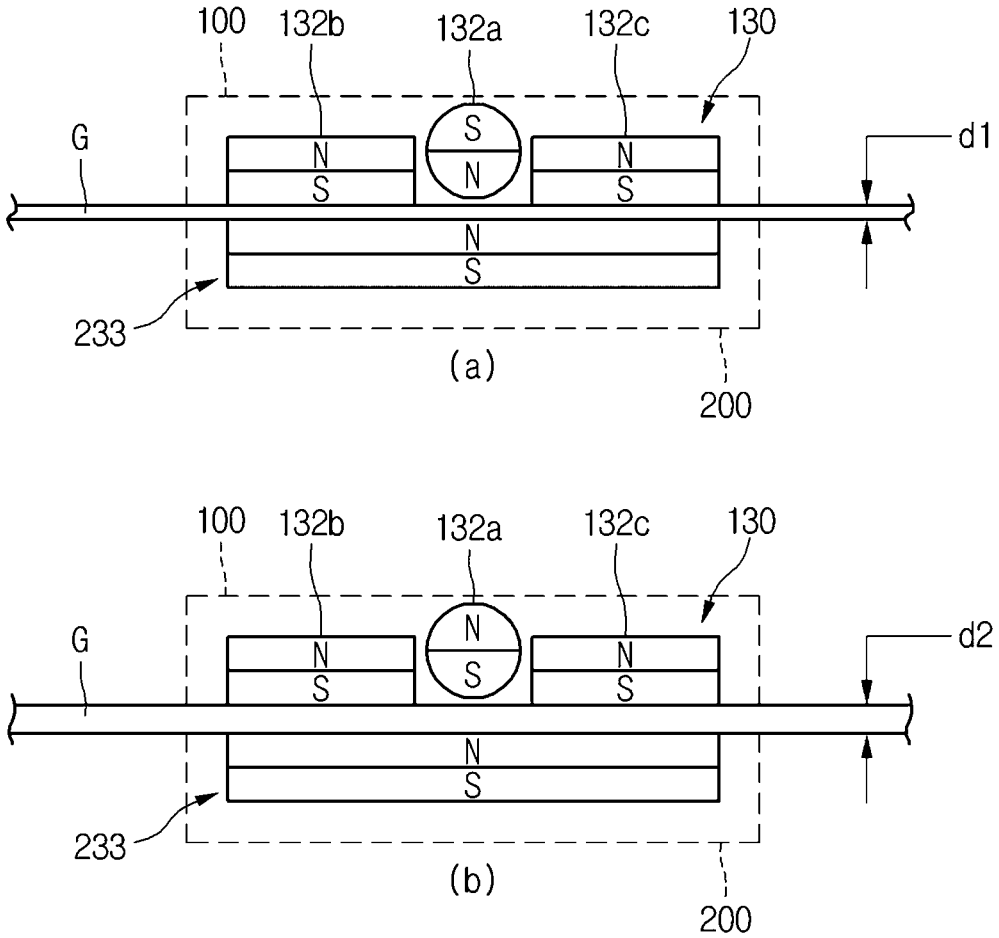
FIG. 5 is a figure for showing a structure of magnetic modules according to an embodiment of the present invention.

FIG. 5 is a cross-sectional view for explaining an embodiment regarding method of adjusting magnetic force, and briefly showing the structure of the first and second cleaning units 100 and 200 with the magnetic modules 130 and 233 as the central figure.

Referring to FIG. 5, a thickness of a window G that is to be cleaned by the window cleaning apparatus according to an embodiment of the present invention may be different. For example, according to a building, position or required function of the window G, the window G with various thickness d may be installed.

On the other hand, if the magnetic force of the first and second magnetic modules 130 and 233 respectively installed in the first and second cleaning units 100 and 200 is supposed to be constant, the magnetic force between the first and second magnetic modules 130 and 233 may be variable according to the thickness d of the window G.

That is, as the thickness d of the window G decreases the magnetic force between the first and second magnetic modules 130 and 233 increases. On the contrary, as the thickness d of the window G increases the magnetic force between the first and second magnetic modules 130 and 233 decreases.

For example, the thickness d1 of the window G in FIG. 5 (*a*) is thinner than the thickness d2 of the window G in FIG. 5 (*b*), so that the magnetic force between the first and second magnetic modules 130 and 233 in FIG. 5 (*a*) is stronger in comparison with that in FIG. 5 (*b*).

As described above, when the magnetic force between the first and second magnetic modules 130 and 233 increases, the movement of the window cleaning apparatus becomes harder. Therefore, the magnetic force between the first and second magnetic modules 130 and 233 may be required to be reduced in case of FIG. 5 (*a*).

In order to adjust the magnetic force between first and second magnetic modules 130 and 233, the first magnetic module 130 in the first cleaning unit includes first to third magnets 132*a*, 132*b* and 132*c*. The first magnet 132*a* disposed at a center is configured to be rotated by a motor so that the magnetic force between the first and second magnetic modules 130 and 233 may be adjusted by rotation of the first magnet 132*a*.

On the other hand, when the magnetic force between the first and second magnetic modules 130 and 233 decreases, the window cleaning apparatus may not be stably attached to a window. Therefore, the magnetic force between the first and second magnetic modules 130 and 233 may be required to be increased in case of FIG. 5 (*b*).

Therefore, according to an embodiment of the present invention, the magnetic force between the first and second cleaning units 100 and 200 may be changed according to the thickness d of the window G. Therefore, the magnetic force controller 310 can adjust the magnetic force between the first and second magnetic modules 130 and 233 so that the magnetic force sensed by the magnetic force sensing part 300 is within the previously set value range.

Hereinbefore, the method of adjusting the magnetic force between the first and second magnetic modules 130 and 233 is performed by controlling the first magnetic module 130 in the first cleaning unit 100 in the above embodiment, but the method of adjusting the magnetic force is not limited to that.

That is, the magnetic force controller 310 may control the second magnetic module 130 in the second cleaning unit 200 in accordance with the magnetic force sensed by the magnetic force sensing part 300. Further, the magnetic force controller 310 may control both of the first and second magnetic modules 130 and 233 such that the magnetic force between the first and second magnetic modules 130 and 233 is within the previous set value range.

As described above, moving stably and easily, a window cleaning robot according to an embodiment of the present invention can clean windows G with various thicknesses d by adjusting the magnetic force between the first and second magnetic modules 130 and 233 to be within the previous set value range.

On the other hand, for example, the case in which the magnetic force between the first and second magnetic modules 130 and 233 is changed according to the thickness d of the window G is explained. However, the magnetic force between the first and second magnetic modules 130 and 233 may be changed according to other factors such as a power supply condition, a window G surface condition, cleaning step, or atmosphere condition, etc.

For example, as shown in FIG. 5 (*a*), when the magnetic force between the first and second magnetic modules 130 and 233 is required to be reduced since the thickness of the window G is thin (d1<d2), the first magnet 132*a* of the first magnetic module is rotated such that the pole of the first magnet 132*a* is opposite to a pole of the second magnetic module 233. In this case, poles of the second magnet 132*b* and the third magnet 132*c* are opposite to the pole of the second magnetic module 233 facing the second magnet 132*b* and the third magnet 132*c* to pull each other, but the first magnet 132*a* faces the second magnetic module 233 with the same poles to push each other.

Therefore, the attractive force between the second and third magnets 132*b* and 132*c* and the second magnetic module 233 is reduced by the repulsive force between the first magnet 132*a* and the second magnetic module 233, so that the attractive force between the first magnetic module 130 and the second magnetic module 233 in total may become smaller than that in FIG. 5 (*b*).

On the contrary, when strong attractive force is required between the first and second magnetic modules 130 and 233 since the window is thick, the first magnet 132*a* is rotated such that the pole of the first magnet 132*a* is opposite to the pole of the second magnetic module 233 to enforce attractive force.

And, the magnetic force between the first and second magnetic modules 130 and 233 may be adjusted by rotation amount (rotation angle) of the first magnet 132. In order for that, the magnetic force controller 310 may keep information of the magnetic force between the first and second magnetic modules in accordance with the rotation angle of the first magnet 132*a*, and control the rotation angle of the first magnet 132*a* according to required magnetic force.

Hereinafter, a method of adjusting magnetic force of the window cleaning apparatus according to an embodiment of the present invention will be explained referring to FIG. 6 through FIG. 13.

Figure 6:
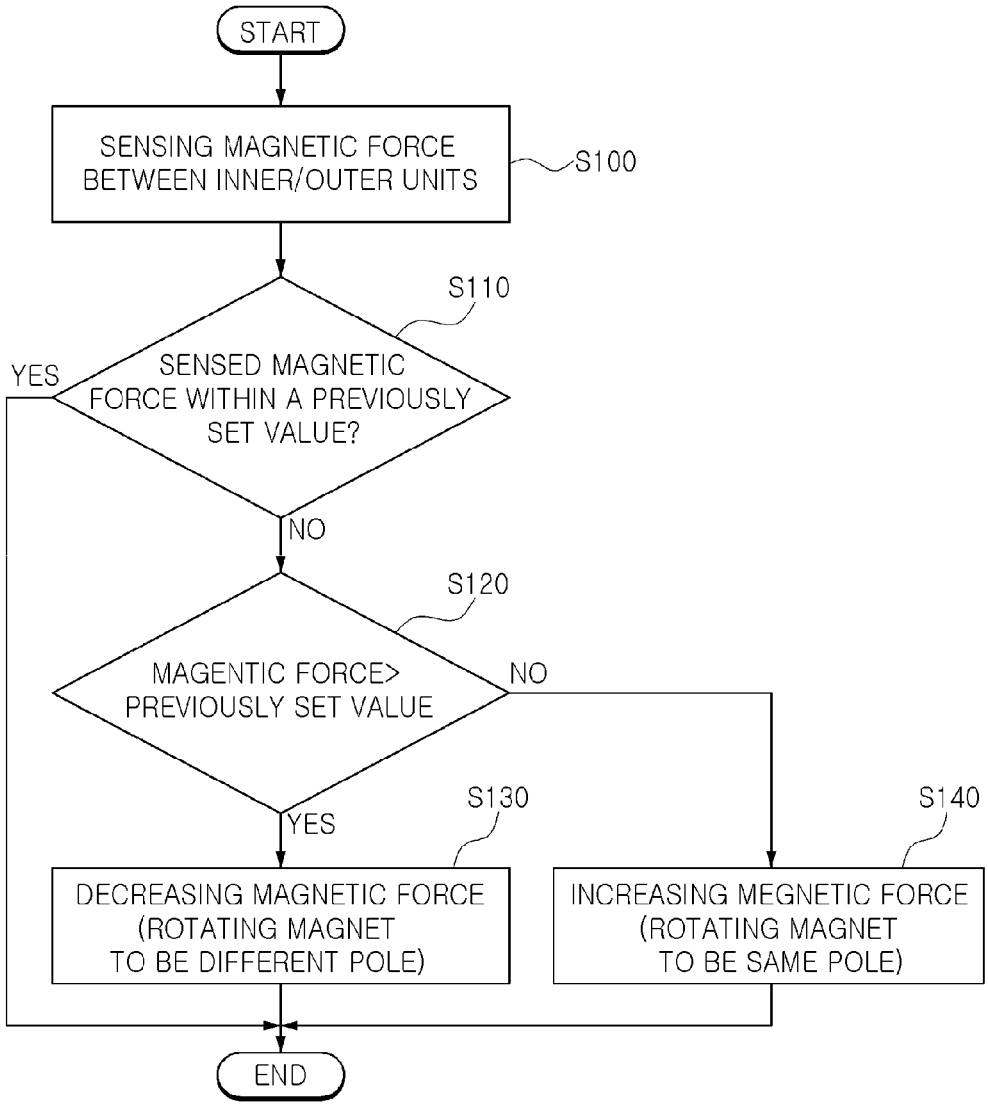
FIG. 6 is a flow chart showing a method of controlling the window cleaning apparatus according to an embodiment of the present invention.

FIG. 6 is a flow chart showing a method of controlling the window cleaning apparatus according to an embodiment of the present invention, and the method in FIG. 6 will be explained in connection with the block diagram in FIG. 4.

Referring to FIG. 6, the magnetic force sensing part 300 included in the window cleaning apparatus senses magnetic force between the first and second cleaning units 100 and 200 (S100). The magnetic force between the first and second cleaning units 100 and 200 may be sensed by the magnetic sensor (not shown) included by the magnetic force sensing part 300, which measures the magnetic force between the first and second magnetic units 130 and 233 respectively included in the first and second cleaning units 100 and 200.

In order for that, the magnetic force sensing part 300 may be included in at least one of the first and second cleaning units 100 and 200, and preferably disposed adjacent to one of the first and second cleaning units 100 and 200.

The magnetic force controller 310 checks if the sensed magnetic force is within the previously set value range (S110), and compares the sensed magnetic force with the previously set value range if the sensed magnetic force is out of the previously set value range (S120).

As a result of comparison, when the sensed magnetic force is greater than the previously set value range, the magnetic force controller 310 reduces the magnetic force between the first and second magnetic modules 130 and 233 (S130). That is, magnetic force controller 310 memorizes rotation direction and rotation amount of the first magnet 132*a* of the first magnetic module 130 to trace if the attractive force or the repulsive force is generated between the first magnet 132*a* and the second magnetic module 233, and the pole of the first magnet 132*a* facing the second magnetic module.

Then, the pole of the first magnet 132*a* facing the second magnetic module 233 is changed in order to reduce the magnetic force.

On the other hand, when the sensed magnetic force is smaller than the previously set value range, the magnetic force controller 310 increases the magnetic force between the first and second magnetic modules 130 and 233 (S130).

For example, supposing that the previously set value is set between maximum value and minimum value, the magnetic force controller 310 can reduce the magnetic force between the first and second magnetic modules 130 and 233 such that the sensed magnetic force is within the previously set value range, when the sensed magnetic force is greater than the maximum value.

Additionally, when the sensed magnetic force is smaller than the minimum value, the magnetic force controller 310 can increase the magnetic force between the first and second magnetic modules 130 and 233 such that the sensed magnetic force is within the previously set value range.

According to an embodiment of the present invention, the method of adjusting magnetic force, which is explained referring to FIG. 6, may be performed when the window cleaning robot starts cleaning, that is when a user attaches the first and second cleaning units 100 and 200 to both sides of a window, respectively.

For example, the magnetic force between the first and second magnetic modules 130 and 233 is initially set to be lower than the previously set value, before starting window cleaning. Therefore, a user can increase magnetic force between the first and second magnetic modules 130 and 233 by using the magnetic force controller 310, after attaching the first and second cleaning units 100 and 200 to the both side of the window, respectively.

Figure 7:
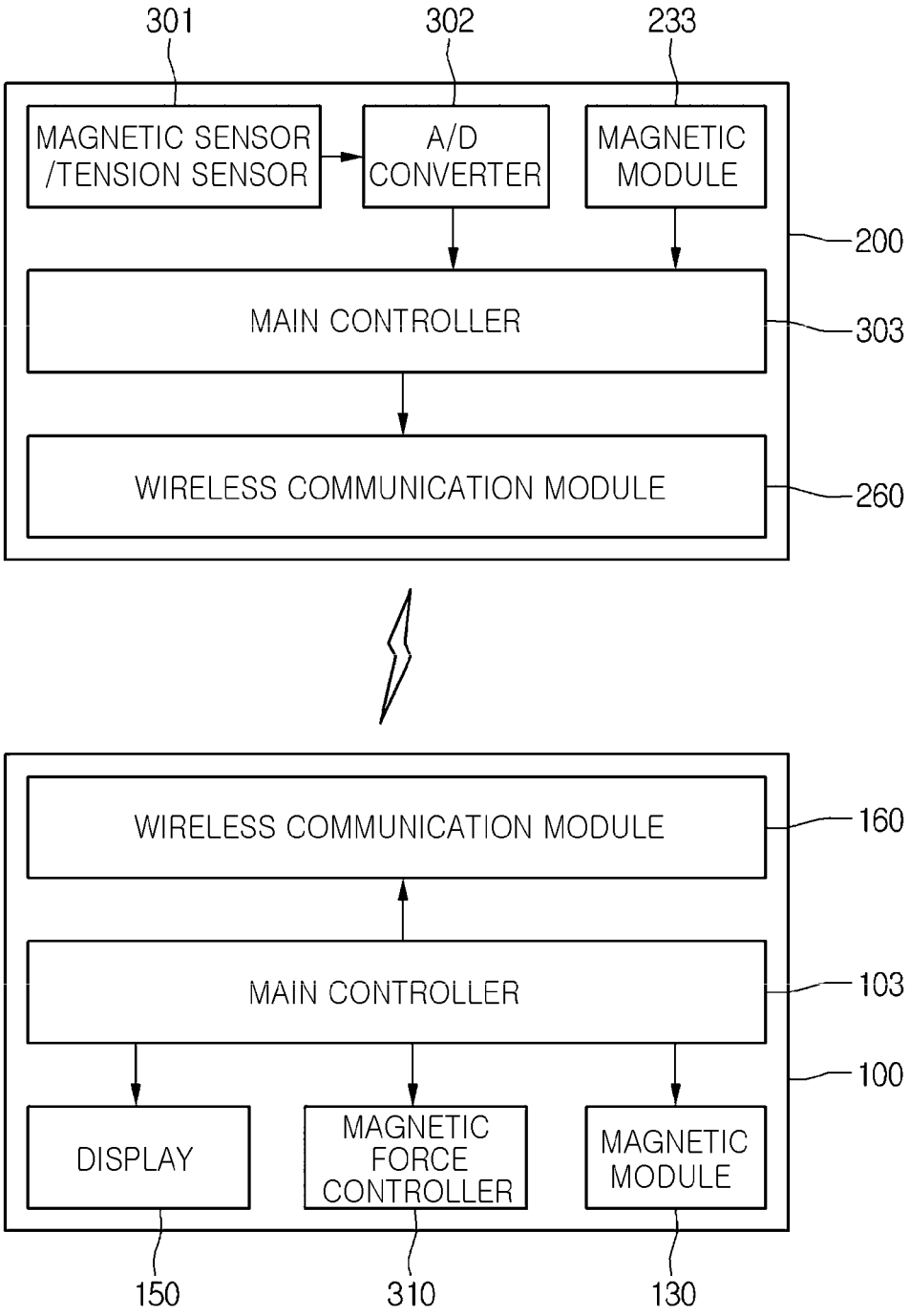
FIG. 7 is a block diagram showing embodiments of first and second cleaning units installed in the window cleaning apparatus.

FIG. 7 is a block diagram showing embodiments of first and second cleaning units installed in the window cleaning apparatus, and explanation regarding elements of the first and second cleaning units 100 and 200, which are explained referring to FIG. 1 through FIG. 6 will be omitted.

Referring to FIG. 7, the first cleaning unit 100 may include a first magnetic module 130, a display part 150, a first wireless communication module 160, a main controller 103 and a magnetic force controller 310, and the second cleaning unit 200 may include a second magnetic module 233, a second wireless communication module 260, a main controller 303, a magnetic sensor 301 or a physical tension sensor (not shown) and A/D converter 302.

At first, the magnetic sensor 301 included in the second cleaning unit 200 senses the magnetic force between the first and second magnetic modules 130 and 233, and the sensed magnetic force may be converted into a digital value by the A/D converter 302. In order for that, the magnetic sensor 301 may be disposed adjacent to the second magnetic module 233.

The first wireless communication module 160 included in the first cleaning unit 100 and the second wireless communication module 260 included in the second cleaning unit 200 may receive and transmit signals through a short-range wireless telecommunication technology such as Bluetooth or Zigbee.

The second wireless communication module 260 transmits the digitalized magnetic force to the first wireless communication module 160 included in the first cleaning unit 100, so that the first cleaning unit 100 receives the magnetic force value that is sensed by the second cleaning unit 200.

The magnetic force value received by the first wireless communication module 160 is inputted to the magnetic force controller 310, and the magnetic force controller 310 controls the first magnetic module 130 in accordance with the inputted magnetic force value to adjust the magnetic force between the first and second magnetic modules 130 and 233.

In this case, the magnetic force controller 310 can adjust the magnetic force between the first and second magnetic modules 130 and 233 through the method explained referring to FIG. 4 through FIG. 7. Therefore, any further explanation will be omitted.

For example, the magnetic force controller 310 can adjust the adjust the magnetic force between the first and second magnetic modules 130 and 233 by rotating the first magnet

132*a* of the first magnetic module 130 to change the pole of the first magnet 132*a*, which faces the second magnetic module.

In more detail, the structure for adjusting the magnetic force according to the embodiment will be explained referring to FIG. 8.

Figure 8:
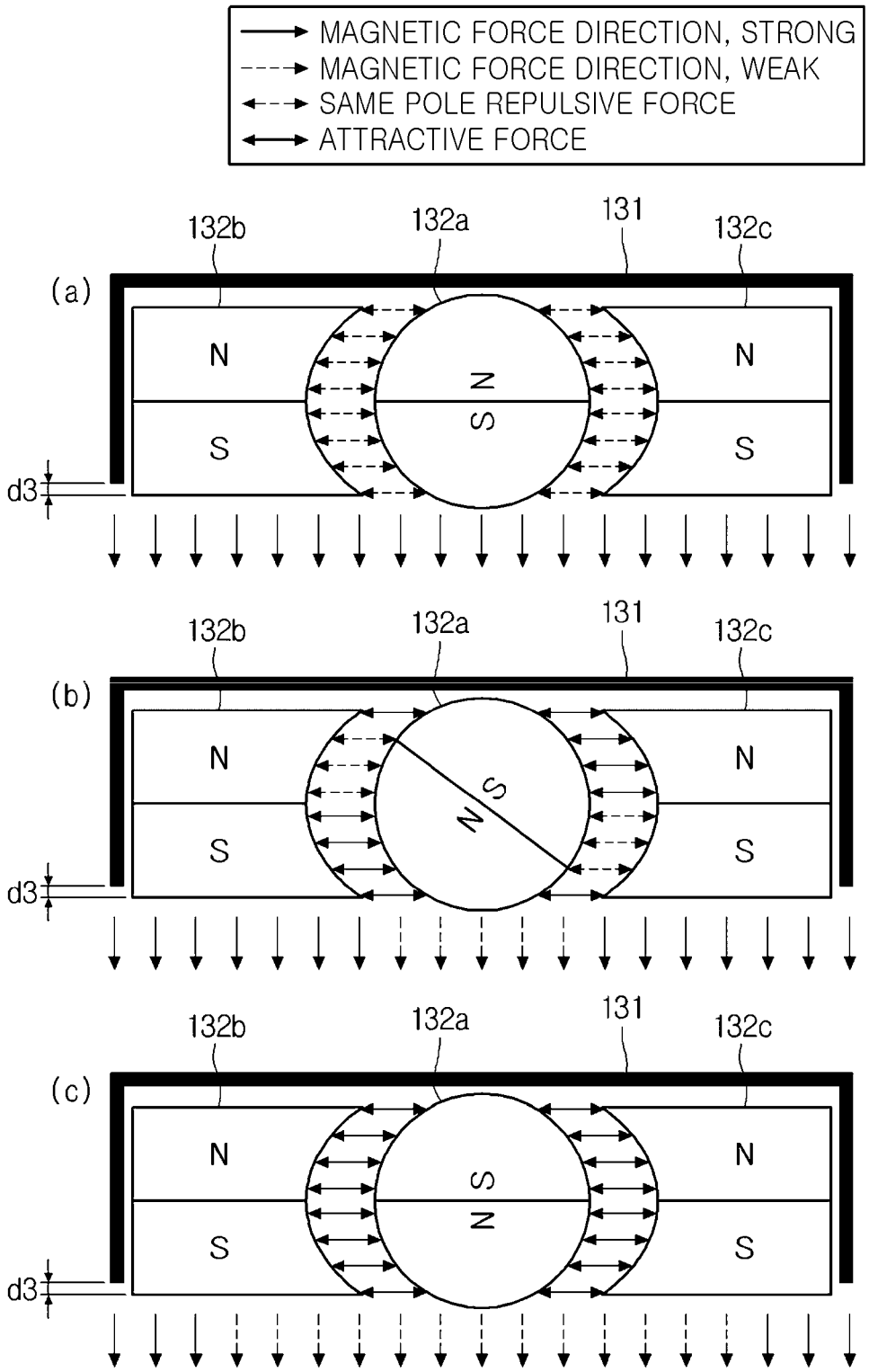
FIG. 8 is a figure for explaining a component of a first magnetic module and magnetic force control according to an embodiment of the present invention.
Figure 9:
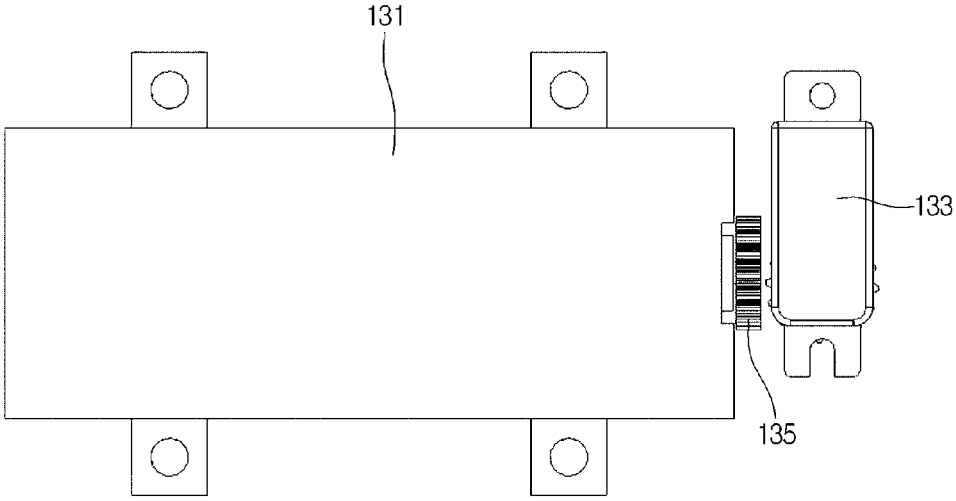
FIG. 9 through FIG. 12 are figures showing a component of a first magnetic module according to an embodiment of the present invention.

FIG. 8 shows the first magnetic module 130 of the first cleaning unit and a module case 131 encasing the first magnetic module 130.

As described above, the first magnetic module 130 includes a first magnet 132*a* configured to be rotated by a driving means such as a motor, and a second magnet 132*b* and a third magnet 132*c* which are disposed at both sides with the first magnet 132*a* as the center.

The second and third magnets 132*b* and 132*c* are disposed such that poles of the second and third magnets 132*b* and 132*c* are opposite to a pole of the second magnetic module 233 facing the second and third magnets 132*b* and 132*c*. Therefore, consistent attractive force is generated between the second and third magnets 132*b* and 132*c* and the second magnetic module 233.

And, the first magnet 132*a* is rotatable so that attractive force or repulsive force may be generated between the first magnet 132*a* and the second magnetic module 233 according to a rotation direction or rotation amount.

And, the module case 131 encases both sides and upper side of the first, second and third magnets 132*a*, 132*b* and 132*c*, and the first to third magnets are designed to protrude out of sides of the module case 131. That is, the module case 131 is formed to be shorter than sides of the second and third magnets 132*b* and 132*c*, so that the magnets are formed protruded by a specific length.

That is because direction of magnetic field may diverge when an iron plate forming the module case 131 is extended to the magnets or protrudes of the module case 131, or may converge to small area of the iron plate. For example, sides of the module case 131 are designed to protrude by about 1 mm (d3) out of the magnets.

FIG. 8(*b*) shows a case where the first magnet 132*a* of FIG. 8(*a*) is rotated by about 45 degrees by a clock-wise direction and the pole of the second magnetic module facing the first magnetic module is the North Pole (N). The second magnet 132*b* and the third magnet 132*c* are disposed such that South Pole of the magnet 132*b* and the third magnet 132*c* faces the second magnetic module 233 to generate attractive force, but the first magnet 132*a* is rotated such that a portion of the North Pole of the first magnet 132*a* faces the second magnetic module 233 to generate repulsive force between the first magnet 132*a* and the second magnetic module.

The repulsive force is smaller than the attractive force between the second and third magnets 132*b* and 132*c* and the second magnetic module 233, so that attractive force is generated between the first and second magnetic module. However, the attractive force in FIG. 8(*b*) is smaller than the attractive force in FIG. 8(*a*).

Further, when the magnetic force between the first and second magnetic modules is required to be reduced more, the first magnet 132*a* is disposed such that the North Pole of the first magnet 132*a* faces the second magnetic module as shown in FIG. 8(*c*). In this case, the magnetic force between the first and second magnetic modules is more reduced in comparison with the magnetic force in 8(*b*).

Hereinafter, a method of adjusting the magnetic force by changing a distance between the first and second magnetic modules 130 and 233 will be explained referring to FIG. 9 through FIG. 12.

FIG. 9 through FIG. 12 are figures showing a component of a first magnetic module according to an embodiment of the present invention.

Referring to FIG. 9 through FIG. 12, the first cleaning unit 100 includes a first magnetic module, a driving member 133 rotating the first magnet that is rotatable for adjusting magnetic force between the first and second magnetic modules, and a gear 135 applying rotating force generated by the driving member 133 to the first magnet.

And, side part of the module case 131 is formed to be small than a thickness of the first through third magnets, so that the first through third magnets protrudes out of the side part of the module case 131.

Figure 10:
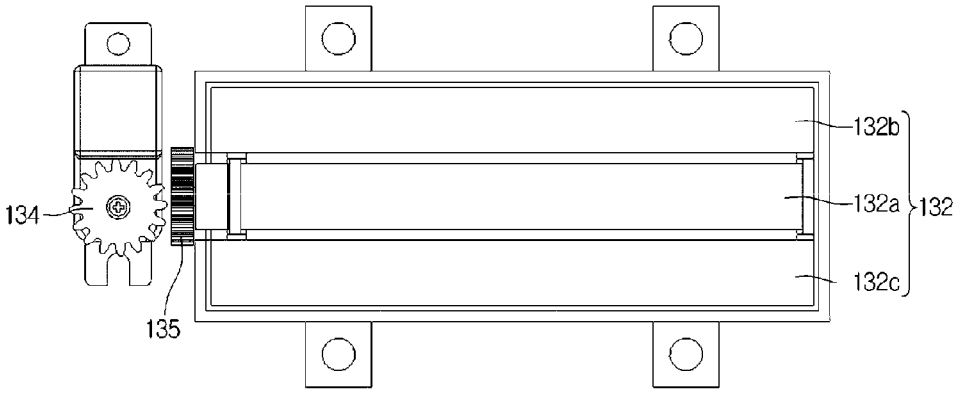
Figure 11:
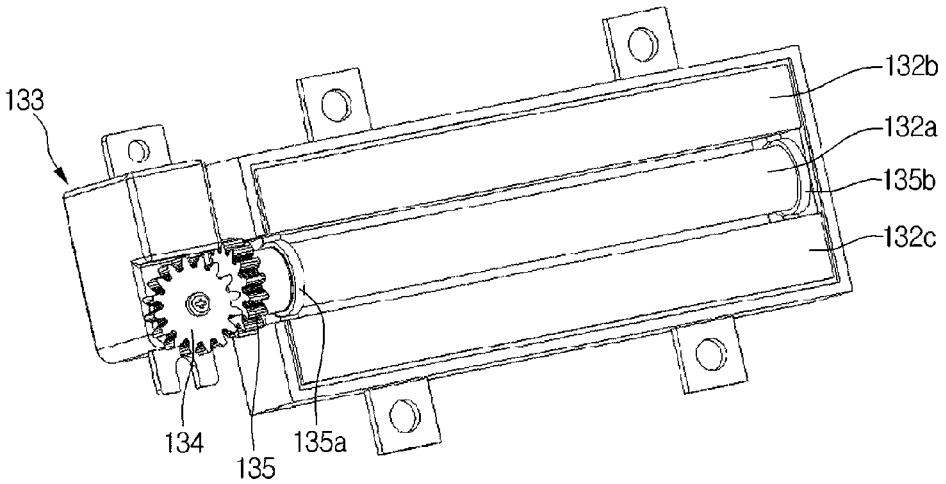
Figure 12:
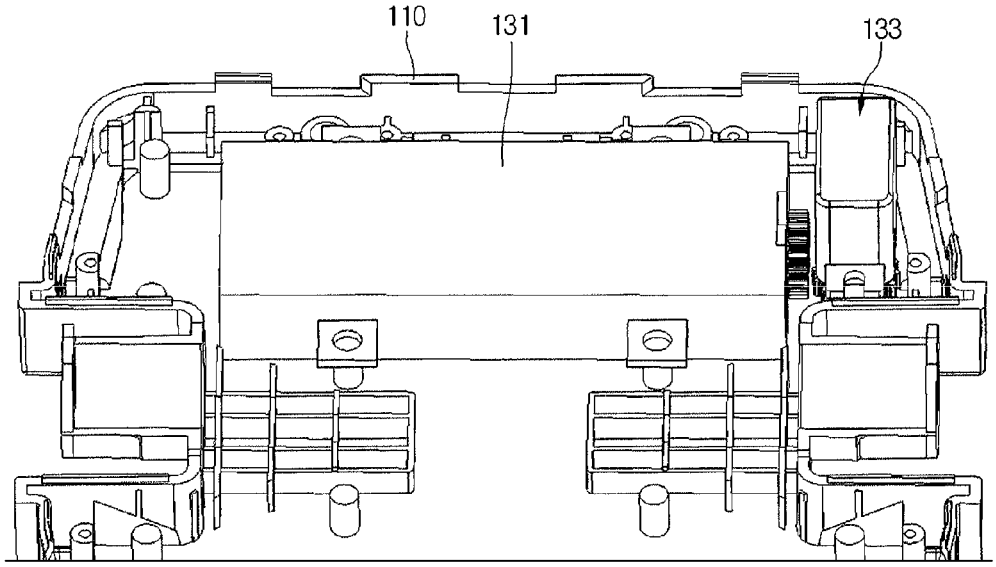

And, as described in FIG. 10 and FIG. 11, the driving member 133 generating the driving force by a motor includes a pinion 134, and the rotating force of the pinion 134 is transferred through the gear 135 to rotate the first magnet 132*a* coupled to the gear 135. The magnetic force controller described above may be the driving member, the pinion and the gear, etc. The gear 135 is formed coupled with a screw thread of the pinion 134.

As described above, the first through third magnets is received by the module case, and the second and third magnets 132*b* and 132*c* is disposed such that poles of the second and third magnets 132*b* and 132*c* are opposite to a pole of the second magnetic module facing the second and third magnets 132*b* and 132*c*. Therefore, consistent attractive force is generated between the second and third magnets and the second magnetic module.

Further, bearings 135*a* and 135*b* are respectively formed at both ends of the first magnets 132*a* for smooth rotation of the first magnet 132*a*.

The method of controlling the window cleaning apparatus may be embodied as a program and may be stored in a computer readable storage medium such as ROM, RAM, CD-ROM, magnetic tape, floppy disc, optical data storage device, etc. Further, the method of controlling the window cleaning apparatus may be embodied as a format of carrier wave (for example, transmission through internet).

The computer readable storage medium may be distributed in a computer system connected by network, and codes that are readable by a computer in a distribution type may be stored and performed. And, functional program, code and code segments for embodying the control method may be easily formed by a programmer ordinary skilled in the art.

In the specifications, the present invention is explained referring to the preferred embodiments, but the embodiments are only examples and the present invention is not limited to that. The present invention may be variously modified and applied. For example, each elements in the embodiment may be modified, and the modification of claimed invention should be included in the present invention.

What is claimed is:

1. A window cleaning robot comprising a first cleaning unit and a second cleaning unit, which are respectively attached to and move on opposite surfaces of a window by magnetic force, the window cleaning robot comprising:

a first magnetic module included in the first cleaning unit;

a second magnetic module included in the second cleaning unit; and a magnetic force or tension sensing part for sensing magnetic force between the first magnetic module and the second magnetic module; and a magnetic force controller for controlling the magnetic force between the first magnetic module and the second magnetic module, wherein the first magnetic module comprises a first magnet a second magnet and a third magnet, the first magnet being rotationally mounted between the second magnet and the third magnet, and the magnetic force controller rotates the first magnet so as to control the magnetic force between the first magnetic module and the second magnetic module.

2. The window cleaning robot of claim 1, wherein the magnetic force controller decreases the magnetic force between the first and second magnetic modules when a sensed magnetic field is greater than a set value, and increases the magnetic force between the first and second magnetic modules when a sensed magnetic field is smaller than the set value.

3. The window cleaning robot of claim 1, wherein the first cleaning unit comprises a gear connected to the first magnet, a pinion coupled to the gear, and a driving member applying rotation force to the pinion.

4. The window cleaning robot of claim 3, further comprising a bearing for rotation of the first magnet.

* * * * *